US009217128B2

(12) United States Patent
Ainscow et al.

(10) Patent No.: US 9,217,128 B2
(45) Date of Patent: Dec. 22, 2015

(54) COMPOSITION INCLUDING ONE OR MORE HYDROLYTICALLY UNSTABLE COMPONENTS

(75) Inventors: Robert Barrie Ainscow, Cheshire (GB); Robert Vernon Ainscow, Manchester (GB); Norman Charles Lowe, Manchester (GB)

(73) Assignee: Chemlink Specialities LTD, Manchester (GB)

( * ) Notice: Subject to any disclaimer, the term of this patent is extended or adjusted under 35 U.S.C. 154(b) by 1833 days.

(21) Appl. No.: 10/579,167

(22) PCT Filed: Nov. 12, 2004

(86) PCT No.: PCT/GB2004/004747

§ 371 (c)(1), (2), (4) Date: Feb. 8, 2007

(87) PCT Pub. No.: WO2005/052108

PCT Pub. Date: Jun. 9, 2005

(65) Prior Publication Data

US 2007/0129277 A1 Jun. 7, 2007

(30) Foreign Application Priority Data

Nov. 14, 2003 (GB) ..... 0326577.4
Sep. 15, 2004 (GB) ..... 0420492.1

(51) Int. Cl.

| | |
|---|---|
| ***C11D 17/04*** | (2006.01) |
| ***C11D 3/18*** | (2006.01) |
| ***C11D 3/32*** | (2006.01) |
| ***C11D 3/395*** | (2006.01) |
| ***C11D 3/20*** | (2006.01) |
| ***C11D 17/00*** | (2006.01) |

(52) U.S. Cl.

CPC ..... *C11D 17/042* (2013.01); *C11D 3/18* (2013.01); *C11D 3/2093* (2013.01); *C11D 17/003* (2013.01); *C11D 17/043* (2013.01)

(58) Field of Classification Search

USPC ..... 510/220, 221, 226, 296, 439

See application file for complete search history.

(56) References Cited

U.S. PATENT DOCUMENTS

| | | | | |
|---|---|---|---|---|
| 5,008,031 | A * | 4/1991 | Schulz et al. | 510/338 |
| 5,328,489 | A | 7/1994 | Beaujean et al. | |
| 5,783,657 | A | 7/1998 | Pavlin et al. | |
| 6,228,825 | B1 | 5/2001 | Gorlin et al. | |
| 6,268,466 | B1 * | 7/2001 | MacQueen et al. | 528/335 |
| 6,524,594 | B1 * | 2/2003 | Santora et al. | 424/401 |
| 7,083,047 | B2 * | 8/2006 | Bone et al. | 206/524.7 |
| 2002/0077264 | A1 * | 6/2002 | Roberts et al. | 510/296 |
| 2002/0123444 | A1 * | 9/2002 | Fisher et al. | 510/297 |
| 2002/0142930 | A1 * | 10/2002 | Smith et al. | 510/218 |
| 2003/0216274 | A1 * | 11/2003 | Del Duca et al. | 510/296 |
| 2004/0063598 | A1 * | 4/2004 | Riebe et al. | 510/293 |
| 2004/0067861 | A1 * | 4/2004 | Denome et al. | 510/221 |
| 2005/0003992 | A1 * | 1/2005 | Del Duca et al. | 510/439 |

* cited by examiner

*Primary Examiner* — Lorna M Douyon
(74) *Attorney, Agent, or Firm* — Gable Gotwals

(57) ABSTRACT

A composition is provided which is suitable for use in a cleaning or washing process. The composition is contained in an aqueous sensitive device and includes at least one aqueous sensitive component and a non-aqueous carrier component for stabilizing said aqueous sensitive component. The non-aqueous carrier component includes a mineral oil and a gelling agent.

19 Claims, No Drawings

COMPOSITION INCLUDING ONE OR MORE HYDROLYTICALLY UNSTABLE COMPONENTS

This invention relates to a composition including one or more hydrolytically unstable or aqueous sensitive components.

Although the following description refers almost exclusively to a cleaning composition including hydrolytically unstable components and water soluble sachets containing such a cleaning composition for use in dishwashers, it will be appreciated by persons skilled in the art that the composition could be used in any application which requires some sort of delivery system or carrier system including hydrolytically unstable components, such as in machine wash compositions, industrial and institutional cleaners, cosmetics, agro chemical adjuvants, bleaching agents, pigments, dyestuffs, corrosion inhibitors, lubricants and/or the like. In addition, the present invention is not restricted to compositions contained in water soluble sachets and can include any water sensitive agent or in fact any type of carrier or dispensing device.

In recent years there has been a move in the field of laundry and hard surface cleaning to provide cleaning compositions in pre-defined dosage forms, such as in the form of tablets for use in washing machines. A problem with cleaning compositions in tablet form is that they typically require a user to handle the product in order to place the tablet, for example, in a washing machine. This is undesirable since the tablet can often disintegrate on handling or the active ingredients contained therein may be harmful to the user or act as an irritant.

In order to overcome this problem, the cleaning composition can be contained in a dosed form, such as a water soluble sachet, thereby removing the requirement for a user to directly contact any active ingredient contained in the sachet. The composition can include a liquid, gel or powder and once the sachets come into contact with water during the cleaning process, such as in the washing machine, the outer film forming the sachet dissolves or disintegrates and the cleaning composition is released therefrom.

Liquid or gel products by virtue of their aesthetic appeal, convenience in handling, ease of measurement, and rapidity if dispersion and dissolution compared to granular products have found favour with consumers. However, a problem with water soluble sachets if the cleaning composition contained therein is to be provided in a gel or liquid form, is that some detergent composition products which are compatible with each other in an anhydrous granular product may interact or exhibit instability to storage in liquid formulations and especially in an aqueous environment, resulting in a reduction in storage stability over time compared with a powder formulation. This is a particular problem if the liquid or gel formulation contains significant quantities of water, as such, the gel or liquid contained in the water soluble sachet results in disintegration of the sachet or gassing of the product over a relatively short time period, such that the manufacturer cannot guarantee the quality of the product reaching the end customer.

In one approach to overcome the negative effects of water in the composition, the water sensitive components are encapsulated in a hydrophobic coating such as a wax. However, the process of encapsulation is time consuming, increases the cost of manufacture and can lead to a reduction in performance due to the need to remove the encapsulating medium before the water sensitive component can be released. Furthermore, products using encapsulation often require a predetermined temperature to be reached before disintegration of the encapsulated coating can take place. The suspension of encapsulated particles tends to show phase instability and sedimentation of components on prolonged storage. One approach to overcome this physical instability has been to employ a structured system wherein the encapsulated particles and/or solid components are dispersed in a highly viscous matrix. Whilst this solution can reduce the rate of sedimentation of components, separation still occurs on prolonged storage particularly in conditions of fluctuating temperature.

It is known to provide formulations, which replace the water in cleaning compositions with non-aqueous agents, such as polar glycolic solvents as disclosed in U.S. Pat. No. 6,228,825. The composition in this document includes a first polyethylene glycol and a second different polyethylene glycol, the different glycols being used to thicken the composition. However, such a formulation is still susceptible to sedimentation of the particulate matter therefrom over prolonged time periods due, at least in part, to the viscosity of the formulation being too low and having no rigidity. As such, products incorporating such formulations often become unusable with time. In addition, polyglycols have restrictions in formulation as they react with anionic surfactants, soaps, cross-linked polymers and chlorine based compounds, such as some bleaching agents. Particulate matter which is mixed with the polyglycols also typically has to be below a predetermined size to provide some degree of stability to the formulation, thereby restricting the particulate matter used and/or requiring the particulate matter to undergo additional treatment steps to ensure the matter is below said pre-determined size. Similar problems are encountered with U.S. Pat. No. 5,328,489, although the composition in this document is not for location in a water-soluble sachet.

A further formulation, which replaces water in a composition with a non-aqueous liquid or solid, is disclosed in U.S. Pat. No. 2002/0077264, which relates to a delivery system. This document discloses that if the formulation is in a liquid form, an example of a non-aqueous liquid that can be used is a $C_{12}$-$C_{14}$ isoparaffin. However, in order to overcome the problems associated with activation of a water sensitive agent, such as bleach, during normal storage of the product, the delivery system includes a water-soluble sachet having two compartments; an inner compartment and an outer compartment. Activation components for the bleach are contained in a separate compartment to the bleaching agent, thereby preventing premature activation of the bleach. A problem with this system is that provision of a two-component system is both expensive to produce and time consuming to manufacture.

U.S. Pat. No. 5,783,657 discloses use of a low molecular weight, ester terminated polyamide with a liquid hydrocarbon to form a transparent composition having a gel consistency which can be used in a cleaning composition but provides no further teaching on a cleaning formulation which would work in practise.

Aqueous or water sensitive components are components which undergo reaction with water and commonly included in cleaning systems, such as bleaching agents, bleaching agent activators, enzymes, anticorrosion agents, biocides, dyestuffs, and fragrances.

A bleaching agent is required for many cleaning compositions in order to remove "bleachable" stains, such as tannin found in tea or red wine, and/or to act as an in situ disinfectant. In laundry powders, bleach is often provided in the form of a persalt, such as Sodium Perborate or Percarbonate, which is often activated in the wash by the addition of a bleach activator, such as Tetra acetyl ethylene diamine. In auto-dishwashing powders, the above components are used or a chlorine-releasing agent is used. However, if bleach is added to a gel or liquid composition, the water in the composition leads to activation of the bleach, which causes disintegration of the sachet and instability of the gel/liquid composition. Of particular importance are peroxygen bleaches such as perborates, percarbonates, persulphates, perphosphates, persilicates and halogen bleaching agents including chloroisocyanurates, chlorinated phosphates, alkali metal hypochlorite and alkaline earth metal hypochlorites. Bleach activators including Tetra acetyl ethylene diamine and transition metal complexes particularly of Manganese and Cobalt. Enzymes selected from the groups Amylases, Proteases and Lipases, may also be incorporated in cleaning compositions to improve soil and stain removal either singly or in combination with other agents for example bleaching compounds.

It is therefore an aim of the present invention to provide a composition including one or more hydrolytically unstable (also referred to as aqueous sensitive hereinafter) components.

It is a further aim of the present invention to provide a composition for location in a dosage system or dispensing device, such as for example an aqueous sensitive device.

According to a first aspect of the present invention there is provided a composition suitable for use in a cleaning or washing process, said composition located in a single compartment of an aqueous sensitive device and including at least one aqueous sensitive component and a non-aqueous carrier component for stabilising said aqueous sensitive component, characterised in that said non-aqueous carrier component includes a mineral oil, a gelling agent and an emulsifying agent for emulsifying the mineral oil.

In one embodiment the composition is locatable in a single compartment of an aqueous sensitive device. The term aqueous sensitive device refers to any device or member which undergoes some level of reactivity with water. Thus for example the device can disintegrate and/or dissolve when brought into contact with an aqueous solution.

In an alternative embodiment the composition can be located in any suitable container, sachet, device, bottle and/or the like.

The water or aqueous sensitive component is substantially homogenised in the mineral oil to provide an inert stabilising carrier system as a continuous phase for the water sensitive component. Since oil is a component that many applications, such as cleaning processes are trying to remove, the provision of oil in the carrier system provides an unexpected technical result in that the overall detergency of the system is not noticeably reduced by the presence of the mineral oil carrier. The gelling agent provides stability of the composition to allow particulate matter to be adequately suspended for prolonged periods of time.

The mineral oil typically acts as a defoamer in the environment of use of the composition, such as a dishwasher or washing machine.

The mineral oil is typically a refined hydrocarbon and in one preferred example is $C_{20}$-$C_{28}$ paraffin due to its lower odour, lower volatility, lower solvent power for plastic and rubber components and lower skin irritancy over more volatile kerosene type fractions, such as $C_{12}$-$C_{14}$ paraffins.

In one embodiment at least 20% of the composition is mineral oil.

Preferably the composition includes at least one emulsifying agent for emulsifying the mineral oil.

The oil emulsifier is provided with the composition to allow the oil to subsequently be removed from the one or more articles or surfaces being treated by or coming into contact with the composition during use of the composition, such as in a cleaning process. In one embodiment the emulsifier is or includes a surfactant used in the continuous phase of the composition.

Preferably at least one emulsifying agent is provided in the composition in an amount between 1-10% of the final composition.

In one embodiment, additional oil components can be used with the mineral oil and can include any or any combination of a vegetable oil, an inert organic liquid, such as fatty acid esters, polyalkylene glycols, other mixtures thereof and/or the like.

In one embodiment the single compartment aqueous sensitive device is a water-soluble sachet. The water-soluble sachet can be formed from any conventional water sensitive film. Examples of possible films are listed in U.S. Pat. No. 2002/0077264. The sachet can contain a single compartment or a number of compartments but the composition according to the present invention is contained in at least one of said compartments.

In one embodiment the aqueous sensitive component is or includes a bleaching agent. Any compound or mixture acting as a bleaching agent can be used in the present invention, such as for example, sodium percarbonate, dichlorocyanurate, bromo-hydantoin and/or tetracetylethylene diamine.

In a preferred embodiment, the bleaching agent is a chlorine or halogen based agent. Halogen containing bleaches have advantages in removing proteinaceous soils, as evidenced in U.S. Pat. No. 5,164,106 and U.S. Pat. No. 6,228,825.

Further preferably a bleach activator is provided in the composition for activating said bleaching agent when mixed with water or an aqueous based solution.

In one embodiment the composition and/or aqueous sensitive component is or includes one or more enzymes.

In a preferred embodiment the composition contains a bleaching agent, bleaching agent activator and one or more enzymes.

The gelling agent is required to suspend the active ingredients of the composition therein (i.e. the aqueous sensitive agents). It acts to increase the viscosity of the composition to a pre-determined level sufficient to provide a substantially homogenous product resistant to separation or sedimentation of particulates.

It is preferred that the gelling agent is provided in an amount between 1-10% of the fluid composition.

The composition can also include any or any combination of one or more detergent builders, fragrant components, inert fillers, water softeners, detergents, pigments, dyes, optical brighteners, enzymes and/or the like. These components can be provided in any required amount, the mineral oil and/or other oil components making up the total amount of the composition to 100%.

According to a second aspect of the present invention there is provided an aqueous sensitive device containing a composition.

Preferably the aqueous sensitive device is a water soluble sachet and the composition is provided in a compartment of said sachet.

According to a third aspect of the present invention there is provided a dosage system for use with a composition.

The dosage system of this aspect of the invention is a means of providing at least one pre-determined dose or amount of the composition to a user or apparatus for use by a user. Examples of a dosage system include any or any combination of one or more containers, bottles, pump type dispensers, sachets and/or the like.

According to a further aspect of the present invention there is provided a method of manufacturing a composition as hereinbefore described.

According to a yet further aspect of the present invention there is provided a water soluble sachet, said sachet containing a composition suitable for use in a cleaning or washing process, said composition contained in a single compartment in said water soluble sachet, said composition including at least one bleaching agent, one or more bleach activating agents and a non-aqueous carrier component for stabilising said bleaching agent, characterised in that said non-aqueous carrier component includes a mineral oil, a gelling agent substantially soluble in said mineral oil and an emulsifying agent for emulsifying the mineral oil.

In one aspect of the present invention a composition is provided which is suitable for use in a cleaning or washing process, said composition including at least one aqueous sensitive component and a non-aqueous carrier component for stabilising said aqueous sensitive component, characterised in that said non-aqueous carrier component is or includes a non-polar solvent and a gelling agent.

Preferably the non-polar solvent is a hydrocarbon and further preferably is a mineral oil.

The advantage of the present invention is that by providing a non-aqueous carrier component in the composition in the form of mineral oil, an aqueous sensitive agent contained in the composition is stabilised until such time that the oil is sufficiently distributed in the process in which the composition is being used, such as a cleaning process, to allow activation of the water sensitive agent by water used in the process. An emulsifying agent is used to remove the oil from the one or more articles and/or surfaces being cleaned. Further advantages include an increased shelf life of the product, removal of problems associated with crystallization of the composition and removal of the requirement for a user to directly handle active ingredients contained in the composition.

The present invention does not incur the cost or time associated with encapsulation techniques or of having two compartments, each compartment providing different elements of the final composition, by allowing the dispersion and suspension of the water sensitive components in an inert medium (i.e. oil medium)

To the best of the applicant's knowledge, the combination of the gelling agent and mineral oil in a composition to form a stable carrier medium has not been shown before. The gelling agent has advantages over other viscosity modifying components, such as polyethylene glycols, in that it is soluble in mineral oil and therefore is able to form a homogenous medium in which the water sensitive component can be distributed.

An example of the present invention will now be described with reference to the following description.

A cleaning composition in the form of an auto dishwashing gel is provided for use in a dosage system in the form of a water-soluble sachet. In accordance with the present invention, the gel also includes water sensitive agents in the form of an enzyme and a bleaching agent and bleaching activator.

A detailed example of a possible cleaning composition according to the present invention is provided below:

| | |
|---|---|
| White Mineral Oil (carrier) | 43% |
| Sylvagel 5000 (gelling agent) | 2% |
| Emulsogen LP (emulsifier, detergent, wetting agent) | 5% |
| SKS-6HD (builder, chelating agent, saponifying agent) | 5% |
| Sodium Disilicate 3NaG (builder, saponifying agent) | 5% |

-continued

| | |
|---|---|
| Tetrasodium Iminodisuccinate (chelating agent, builder) | 3% |
| Peractive AC blue (low temperature bleach activator) | 0.4% |
| Carrubba C9479 (fragrance) | 0.1% |
| Savinase 6D (enzyme for removal of protein stains) | 2% |
| Sodium Percarbonate (bleaching agent) | 1% |
| Sodium chloride (water softener conditioner) | 35.5% |

In accordance with the method of production of the formulation, the mineral oil and the gelling agent are mixed together in a receptacle at a temperature at or above the melting point of the gelling agent (i.e. 95° C. in this example) in order to facilitate the dispersion of the gelling agent in the oil, until the mixture is substantially homogenous and the gelling agent is substantially dissolved in the oil. At this stage the emulsifier is added and the mixture is then allowed to cool in the receptacle whilst being stirred.

Once the mixture is cooled to approx. 70° C., the water softener conditioner and the builders and saponifying agent/chelating agents are added to the mixture in the receptacle. The mixture is stirred until it has cooled to approx. 40° C.

The bleach activator and bleaching agent are then added to the mixture in the receptacle and the mixture is stirred until the temperature of the same is 35° C., after which time the fragrance is added. Finally the enzyme is added and the mixture stirred until the temperature of the same falls below 30° C., after which time the mixture is located in the water-soluble sachet for boxing and packing.

Since the mixture is substantially homogenous, the water sensitive components, such as the bleach activator, the bleaching agent and the enzyme are encompassed by the carrier agent in the form of the oil, thereby preventing activation of the bleach and its possible adverse interaction with the enzyme and the water soluble sachet.

The temperatures and conditions provided in this example do not limit the invention in any way and are typically dependent on the components used in the system and composition to minimise thermal degradation of the relevant components.

The gel in the present invention is a colloid in which a disperse phase has been combined with a disperse medium to produce a semisolid jelly like material. It has rigidity and a defined pour point that maintains its integrity with temperature change up to the pour point, when the material becomes liquid. The gel system prevents or at least significantly reduces sedimentation by trapping particulate matter in a substantially solid matrix and this stability is independent of particle size.

The gelling agent can be a tertiary amide terminated polyamide or hydrocarbon-terminatedpolyether-polyamide block copolymer, such as Sylvagel 5000 obtainable from Arizona Inc, USA.

Thus, the present invention provides a non-aqueous gel that can carry water sensitive components whilst stabilising said components for a pre-determined period of time. The carrying system is a polymeric component that provides good suspension power, is advantageous in terms of cost and improves the performance of the composition.

The invention claimed is:

1. A composition suitable for use in a cleaning or washing process, said composition comprising:

at least one aqueous sensitive component and a non-aqueous carrier component for stabilizing said aqueous sensitive component, characterized in that said non-aqueous carrier component includes a mineral oil, a mineral oil gelling agent and an emulsifying agent for emulsifying the mineral oil and said aqueous sensitive component includes a bleaching agent;

wherein said composition is located in a single compartment of an aqueous sensitive device.

2. A composition according to claim 1 further comprising: the aqueous sensitive component is substantially homogeneous with the non-aqueous carrier component.

3. A composition according to claim 1 said emulsifying agent comprising a surfactant.

4. A composition according to claim 1 further comprising the emulsifying agent is provided in an amount between 1-10% in the composition.

5. A composition according to claim 1 the aqueous sensitive device comprising is an aqueous soluble sachet.

6. A composition according to claim 1 the bleaching agent is comprising a halogen based bleaching agent.

7. A composition according to claim 1 comprising the bleaching agent includes any or any combination of sodium percarbonate, dichlorocyanurate, bromo-hydantoin or tetracetylethylene diamine.

8. A composition according to claim 1 the composition comprising a bleach activator for activating said bleaching agent when mixed with an aqueous solution.

9. A composition according to claim 1 the aqueous sensitive component further comprising an enzyme.

10. A composition according to claim 1 further comprising the gelling agent is provided in an amount between 1-10% of the composition.

11. A composition according to claim 1 further comprising the gelling agent is a tertiary amide terminated polyamide or hydrocarbon-terminated polyether-polyamide block copolymer.

12. A composition according to claim 1 further comprising the composition includes any or any combination of one or more detergent builders, fragrant components, inert fillers, water softeners, detergents, pigments, dyes or optical brighteners and enzymes.

13. A composition according to claim 1 the mineral oil comprising $C_{20}$-$C_{28}$ paraffin.

14. A composition according to claim 1 further comprising the gelling agent is substantially soluble in the mineral oil.

15. A composition is according to claim 1 further comprising said composition is an auto dishwashing gel composition.

16. A composition according to claim 1 further comprising said composition a cleaning composition.

17. A water soluble sachet comprising, a composition suitable for use in a cleaning or washing process, said composition contained in a single compartment in said water soluble sachet, said composition including, one or more bleach activating agents, an aqueous sensitive component having at least one bleaching agent and a non-aqueous carrier component for stabilizing said bleaching agent, wherein said non-aqueous carrier component includes a mineral oil, a mineral oil gelling agent substantially soluble in said mineral oil and a mineral oil emulsifying agent for emulsifying the mineral oil.

18. A water soluble sachet according to claim 17 further comprising one or more enzymes are contained in the composition and/or sachet.

19. A composition suitable for use in a cleaning or washing process, said composition comprising:

an aqueous sensitive component having a bleaching agent;

a non-aqueous carrier component for stabilizing said aqueous sensitive component;

a bleach activator for activating said bleaching agent when mixed with an aqueous solution; and said composition located in a single compartment of an aqueous sensitive device holding said composition;

wherein said non-aqueous carrier component includes a mineral oil, a mineral oil gelling agent and an emulsifying agent for emulsifying the mineral oil.

* * * * *